US006699592B2

(12) United States Patent
Taira et al.

(10) Patent No.: US 6,699,592 B2
(45) Date of Patent: Mar. 2, 2004

(54) GALVANNEALED STEEL SHEET AND METHOD FOR MANUFACTURING THE SAME

(75) Inventors: Shoichiro Taira, Fukuyama (JP); Yoshiharu Sugimoto, Fukuyama (JP); Junichi Inagaki, deceased, late of Yokohama (JP), by Tomoko Inagaki Legal Representative; Toru Imokawa, Fukuyama (JP); Shuji Nomura, Fukuyama (JP); Michitaka Sakurai, Fukuyama (JP); Masaaki Yamashita, Fukuyama (JP); Kaoru Sato, Yokohama (JP); Masayasu Nagoshi, Kawasaki (JP); Akira Gamou, Fukuyama (JP); Yoichi Miyakawa, Kasaoka (JP); Shunsaku Node, Kasaoka (JP); Masahiro Iwabuchi, Fukuyama (JP)

(73) Assignee: NKK Corporation, Tokyo (JP)

( * ) Notice: Subject to any disclaimer, the term of this patent is extended or adjusted under 35 U.S.C. 154(b) by 0 days.

(21) Appl. No.: 10/274,808

(22) Filed: Oct. 21, 2002

(65) Prior Publication Data

US 2003/0175548 A1 Sep. 18, 2003

Related U.S. Application Data

(63) Continuation of application No. PCT/JP01/00190, filed on Jan. 15, 2001.

(30) Foreign Application Priority Data

| | | |
|---|---|---|
| Apr. 24, 2000 | (JP) | 2000-122280 |
| Jul. 13, 2000 | (JP) | 2000-212591 |
| Dec. 4, 2000 | (JP) | 2000-368329 |

(51) Int. Cl.[7] ..... B32B 15/18; B05D 1/18

(52) U.S. Cl. ..... 428/659; 148/280; 148/284; 148/516; 148/533; 148/534; 427/248.1; 427/256; 427/287; 427/433; 427/436; 428/628; 428/629; 428/633; 428/687; 428/469; 428/926

(58) Field of Search ..... 428/659, 628, 428/629, 633, 687, 469, 926; 148/280, 284, 516, 533, 534; 427/248.1, 256, 287, 433, 436

(56) References Cited

U.S. PATENT DOCUMENTS 4,125,679 A * 11/1978 Mino et al. ..... 428/659

FOREIGN PATENT DOCUMENTS

| | | |
|---|---|---|
| EP | 0 778 362 A | 6/1997 |
| JP | 53-60332 A | 5/1978 |
| JP | 63-230861 A | 9/1988 |
| JP | 1-319661 A | 12/1989 |
| JP | 2-190483 A | 7/1990 |
| JP | 2-258962 A | 10/1990 |
| JP | 3-191093 A | 8/1991 |
| JP | 4-88196 A | 3/1992 |
| JP | 8-325689 A | 12/1996 |
| JP | 9-263965 A | 10/1997 |
| JP | 9-263966 A | 10/1997 |

* cited by examiner

*Primary Examiner*—Robert R. Koehler
(74) *Attorney, Agent, or Firm*—Frishauf, Holtz, Goodman & Chick, P.C.

(57) ABSTRACT

The invention provides a galvannealed steel sheet which has an oxide layer having 10 nm or larger thickness on the plateau of the coating layer flattened by temper rolling. With the use of the galvannealed steel sheet, no powdering occurs during press-forming, and stable and excellent sliding performance is attained. By selecting the area percentage of the plateau of the flattened coating layer to a range from 20 to 80%, making the coating layer single layer of δ1 phase, and letting ζ phase exist in the δ1 phase, further improved sliding performance and anti-powdering property are obtained.

29 Claims, 4 Drawing Sheets

GALVANNEALED STEEL SHEET AND METHOD FOR MANUFACTURING THE SAME

This application is a continuation application of International Application PCT/JPO1/00190 (not published in English) filed Jan. 15, 2001.

BACKGROUND OF THE INVENTION

1. Field of the Invention

The present invention relates to a galvannealed steel sheet having excellent sliding performance during press-forming and to a method for manufacturing thereof.

2. Description of Related Arts

Galvannealed steel sheets are used in wide industrial fields centering on the automobile body owing to the excellent weldability and paintability compared with those of galvanized steel sheets. The galvannealed steel sheets are, however, difficult in smooth entering into a die during press-forming at a portion that is sandwiched between the die and a bead, where the sliding resistance increases. In other words, the galvannealed steel sheets do not have superior sliding performance and likely induce fracture compared with ordinary cold-rolled steel sheets.

In a galvannealed steel sheet, heat treatment applied after zinc-coated makes iron in the steel sheet and zinc in the coating layer diffuse to form an Fe—Zn alloy phase. Generally, the alloy phase consists of Γ phase, δ1 phase, and ζ phase, gives Fe concentration decreasing in the order of ζ phase, δ1 phase, and 70 phase, and has a tendency of decreasing the hardness and the melting point in that order. Accordingly, from the point of sliding performance during press-forming, it is effective to form an alloy phase containing large amount of Fe, having high hardness and high melting point, and therefore being difficult to induce adhesion.

If, however, an alloy phase containing large amount of Fe is formed, a hard and brittle Γ phase likely appears on the interface between the coating layer and the steel sheet, which likely induces what is called the powdering, or a phenomenon of separation of coating layer from the interface during press-forming.

As a means to provide both the sliding performance and the anti-powdering property, JP-A-1-319661, (the term "JP-A" referred herein signifies the "unexamined Japanese patent publication"), discloses a method of forming a hard iron-base alloy layer as a second layer on the coating layer using electrodeposition coating treatment or the like.

The method, however, requires additional coating treatment after hot dip galvanization, which makes the process complex and significantly increases the cost.

A widely used method for improving the press-formability of zinc-base coated steel sheets is to apply high viscosity lubricant oil on the steel sheet. The method, however, raises a problem of generation of coating defects during painting caused by insufficient degreasing, and a problem of instable press-formability caused by lack of oil during press-forming.

To this point, JP-A-53-60332 and JP-A-2-190483 provide methods to improve the press-formability and the weldability by forming an oxide film consisting mainly of ZnO on the surface of coating layer on the zinc-base coated steel sheet using electrodeposition coating treatment, immersion treatment, application and oxidation treatment, heating treatment, or the like.

JP-A-4-88196 provides a method to improve the press-formability and the chemical conversion treatment performance by forming an oxide film consisting mainly of P-oxide on the surface of the coating layer by immersing a zinc-base coated steel sheet in an aqueous solution containing 5 to 60 g/l of sodium phosphate, at 2 to 6 of pH, by conducting electrodeposition coating treatment in the aqueous solution, or by applying the aqueous solution onto the surface of the steel sheet.

Furthermore, JP-A-3-191093 provides a method to improve the press-formability and the chemical conversion treatment performance by forming a Ni-oxide film on the surface of the coating layer on the zinc-base coated steel sheet using electrodeposition coating treatment, immersion treatment, application treatment, application and oxidation treatment, heating treatment, or the like.

Nevertheless, the experiments of forming those types of oxide film on the surface of galvannealed steel sheet, conducted by the inventors of the present invention, not necessarily gave excellent sliding performance.

SUMMARY OF THE INVENTION

An object of the present invention is to provide a galvannealed steel sheet that does not generate powdering during press-forming and that assures stable and excellent sliding performance, and to provide a method for manufacturing thereof.

The object is attained by a galvannealed steel sheet having an oxide layer having 10 nm or larger thickness on plateau of coating layer flattened by temper rolling.

The steel sheet can be manufactured by a method for manufacturing a galvannealed steel sheet comprising the steps of: applying hot dip galvanization to a steel sheet; heating the hot dip coated steel sheet to alloy the coating layer; applying temper rolling to the galvannealed steel sheet; and forming a zinc-base oxide layer on the surface of coating layer of the galvannealed steel sheet after the temper rolling.

DETAILED DESCRIPTION OF THE INVENTION

The inventors of the present invention conducted detail study on the causes of failing in attaining stable and excellent sliding performance even when an oxide layer is formed on the surface of coating layer of a galvannealed steel sheet, and found that the reactivity at the surface is poor owing to the Al oxide which exists non-uniformly on the surface, and that the surface irregularity is large. That is, at portions rich in Al oxide, the reactivity at the surface is poor so that ordinary electrodeposition coating treatment, immersion treatment, application and oxidation treatment, or heating treatment is difficult in forming a thick oxide layer and cannot form an uniform oxide layer. In addition, since the surface irregularity is large, the die directly contacts with the plateau of the coating layer. At that moment, the sliding resistance increases at the plateau of the coating layer having a thin oxide layer, which likely induces fracture.

Figure 1:
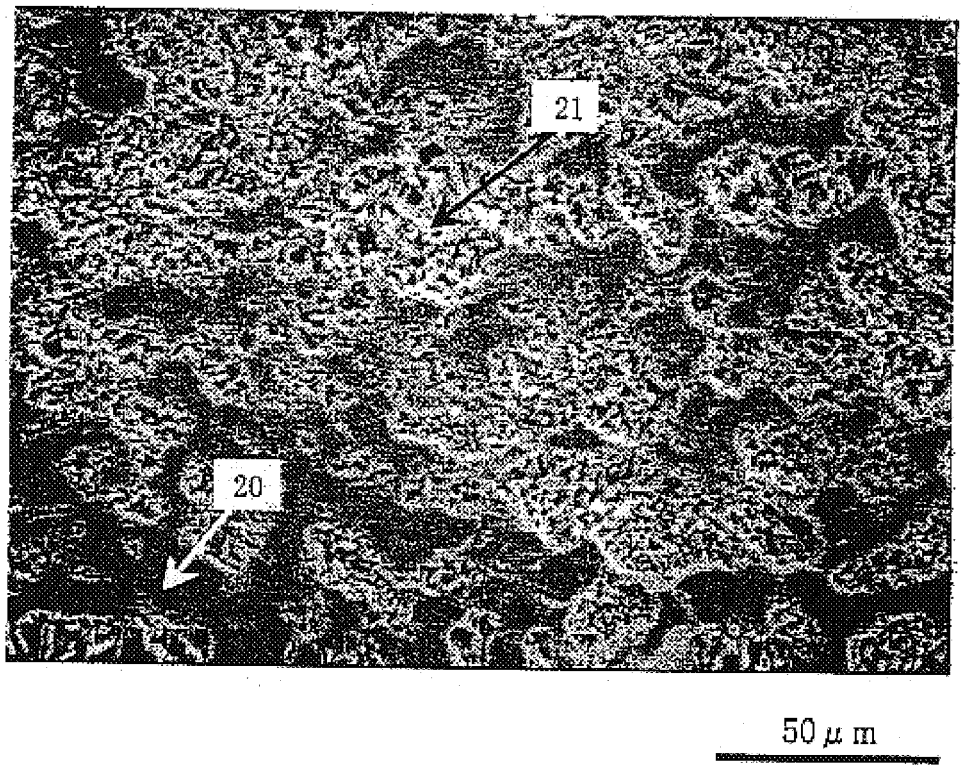
FIG. 1 shows a SEM image giving an example of plateau of the coating layer flattened by temper rolling.

To this point, the inventors of the present invention conducted investigation on the thickness of the oxide layer of the plateau to reduce the sliding resistance and to prevent fracture during press-forming, and found that, as shown in FIG. 1, the formation of 10 nm or larger thickness of oxide layer, preferably 20 nm or larger thickness, on the plateau 20 of the coating layer flattened by temper rolling satisfies the requirement. With that thickness of the oxide layer, no degradation of sliding performance occurs even if the oxide layer wears during press-forming. Although there is no specific upper limit of the oxide layer thickness, exceeding 200 nm thereof results in extreme degradation of reactivity of the surface, and results in difficulty in forming chemical conversion film. Consequently, the thickness of the oxide layer is preferably 200 nm or less.

Determination of the thickness of oxide layer may be done by Auger electron spectroscopy (AES) combined with Ar ion sputtering. That is, after applying sputtering to a specified depth of the oxide layer, the composition of the oxide layer at the depth is determined based on the spectral intensity of each target element while applying correction of relative sensitivity factor, and the depth where the sum of the maximum value of O content and the value of succeedingly reduced in the O content to a stable level becomes ½ is adopted as a thickness of the oxide layer.

Preferably the area percentage of the plateau of the flattened coating layer is 20 to 80%. If the percentage is less than 20%, the portions other than the plateau of the flattened coating layer, or the contact area with the die at the portions without contacting temper rolling expressed by the reference number 21 in FIG. 1, increase, and the area percentage of the plateau of the flattened coating layer, which surely controls the thickness of the oxide layer, decreases, thus decreasing the effect of improving the sliding performance. Since the portions without contacting temper rolling play a role in holding press work oil during press-forming, if the area percentage of portions without contacting temper rolling becomes less than 20%, or if the area percentage of plateau of the flattened coating layer exceeds 80%, absence of oil likely occurs to decrease the effect of improvement in press-formability. The area percentage of plateau of the flattened coating layer means the percentage of flat portions in the observation field, obtained by observing the surface of the coating layer using an optical microscope or a scanning electron microscope (SEM) and by applying image analysis.

Since the plateau of the flattened coating layer are portions with which the die directly contacts during press-forming, it is preferable that a hard material having high melting point that prevents adhesion with the die exists in view of sliding performance. To this point, a sole δ1 phase coating layer is effective.

In that case, however, alloying treatment to increase the Fe content in the coating layer is required. The treatment forms a hard and brittle r phase between the coating layer and the steel sheet, which likely induces powdering. Therefore, it is preferred to form a coating layer consisting mainly of δ1 phase and further containing ζ phase.

Particularly, existence of ζ phase in the surface of the coating layer on at least one side of the steel sheet reduces the content of Γ phase, which is effective to prevent powdering. If the ζ phase exists in the surface of the coating layer, the reactivity of surface increases, which allows effectively forming an oxide layer on the convex portions of the flattened coating layer.

To let the ζ phase surely exist on the surface of the coating layer, it is preferred to keep the X-ray diffraction peak ratio between ζ phase and δ1 phase, (ζ/δ), in the coating layer to 0.2 or more, or to keep the area percentage of ζ phase on the surface of coating layer to 10% or more. The X-ray diffraction peak ratio between ζ phase and δ1 phase was determined from the ratio therebetween while subtracting background noise from the X-ray diffraction peak intensity responding to the lattice spacing d=1.900 A (for ζ phase) and d=1.990 A (for δ1 phase). The area percentage of ζ phase means the percentage of area of columnar crystals, which are presumably the ζ phase, in the observation area of coating layer on SEM image. In this observation, when the X-ray diffraction peak ratio (ζ/δ) is less than 0.2 or when the area percentage of ζ phase is less than 10%, it is assumed that no ζ phase exists at least in the surface of the coating layer.

The galvannealed steel sheet according to the present invention may be manufactured by applying hot dip galvanization to a steel sheet, alloying the coating layer by heating the steel sheet, applying temper rolling, and then forming an oxide layer on the surface of the coating layer.

After completed the temper rolling, if an oxide layer is formed after removing the oxide layer formed during the alloying step to activate the surface, more uniform oxide layer is formed, which is preferable in view of sliding performance. This is because the non-uniform reaction caused by the oxide layer left after the temper rolling is prevented during the formation of oxide layer. To remove the oxide layer left after the temper rolling, mechanical method such as grinding or chemical method such as dipping in alkaline solution and spraying alkaline solution may be applied.

There are various methods for forming oxide layer, as described below.

1. Method of Contacting With High Temperature Steam

According to the method, Zn easily forms oxide by contacting with a neutral solution, and the reaction rapidly proceeds in a high temperature state. Consequently, the oxide layer necessary for improving the sliding performance can be formed within a short time.

2. Method of Heating in an Atmosphere of 20% or Larger Oxygen Content

3. Method of Contacting With an Aqueous Solution Containing an Oxidizing Agent

The method can form oxide layer at relatively low temperatures around room temperature.

4. Method of Repeating Cycles of Contacting With Water and Immediately Following Drying The mechanism of the formation of oxide layer is not clearly analyzed. Although Zn easily forms oxide by contacting with a neutral solution, further contact with air would enhance the formation of the oxide.

At that moment, if the water temperature is brought to 50° C. or above, the formation of oxide is accelerated, which allows shortening the contact time.

Furthermore, when the number of repeating cycles of contacting with water followed by immediate drying is 3 or more, further uniform oxide layer is formed.

5. Method of Contacting With an Acidic Solution, Followed by Washing With Water

Although the mechanism of the formation of oxide layer is not clearly analyzed, presumable mechanism is as follows.

When a galvannealed steel sheet is brought into contact with an acidic solution, Zn dissolution occurs and hydrogen is generated on the surface of the coating layer, which results in increase in pH of the surface of the coating layer, and Zn hydroxide likely forms. By the succeeding washing with water, the formation of Zn hydroxide is enhanced to form the oxide layer.

At that moment, if the pH of the acidic solution is brought to 1 or more, the oxide more easily forms. If pH is excessively high, the reaction rate of Zn dissolution decreases. Accordingly, pH is preferably 5 or less. If the solution temperature is 50° C. or above, the Zn dissolution and the oxide formation are further enhanced.

The water temperature for washing is preferably adjusted to 50° C. or above.

After contacting with an acidic solution, if the water washing is given after allowed standing for 1.0 to 30.0 seconds, the formation of Zn hydroxide is further enhanced to surely form the oxide layer.

When the coating weight of the contacted acidic solution is 3.0 g/m$^2$ or less per a side of the steel sheet, the formation of Zn hydroxide is further enhanced to more surely form the oxide layer. The adjustment of the coating weight may be done by squeezing roll or air wiping.

If the acidic solution contains Fe ion and/or Zn ion, the dispersion of frictional coefficient after the oxidation treatment decreases. Since these ions are ingredients of the coating layer, they do not give bad influence even if they are left on the surface of the coating layer. An example of the acidic solution containing Fe ion and/or Zn ion is an Fe—Zn-base coating bath. In particular, treating the steel sheet through an electrodeposition coating line without applying electric current provides similar effect as that described above.

Alternatively, contact of the steel sheet with a coating solution prepared by diluting the Fe—Zn coating bath is also effective to form oxide layer. Although the mechanism of formation of oxide layer is not fully analyzed, presumable mechanism is the following. Since the Fe—Zn coating bath is acidic, when the galvannealed steel sheet is immersed therein, Zn dissolution occurs on the surface of the coating layer. At the same time, hydrogen is generated to increase pH at the surface of the coating layer, thus making the formation of Zn hydroxide easy. When the steel sheet is brought into contact with ordinary Fe—Zn coating bath, the pH is low so that it is necessary to remove the coating solution which was intentionally left for preventing excessive etching of the coating layer and to further increase pH to enhance the formation of Zn hydroxide. If, however, the contacted coating solution is diluted one, the pH is high so that there is no anxiety of excessive etching on the surface of coating layer, and small amount of Zn dissolution can easily increase the pH at the surface of coating layer, thus relatively easily forming the oxide layer.

The dilution rate of the coating solution is necessarily 100 fold or more from the point of prevention of excessive etching. Excessive dilution, however, hinders the Zn dissolution reaction, so the dilution rate is preferably 10,000 fold or less.

An example of the acidic solution containing Fe ion and/or Zn ion is a solution containing one or more of sulfate, nitrate, and chloride of Fe and/or Zn. In that case, the required pH of solution is within the above-given range, and the concentration of the solution is not limited.

The oxide layer according to the present invention is a layer made by an oxide and/or a hydroxide of one or more of Zn, Fe, Al, and other metal elements.

To manufacture the galvannealed steel sheet according to the present invention, Al is required to exist in the coating bath. Nevertheless, existing or adding the metal elements other than Al, such as Pb, Sb, Si, Sn, Mg, Mn, Ni, Ti, Li, and Cu does not give bad influence on the effect of the present invention. Furthermore, even when the treating solution used in oxidation treatment includes impurities, and resulting in inclusion of S, N, P, B, Cl, Na, Mn, Ca, Mg, Ba, Sr, Si, or the like in the oxide layer, they do not give bad influence on the effect of the present invention.

EXAMPLE 1

Cold-rolled steel sheets having 0.8 mm of thickness were treated by normal galvannealing to form a coating layer having a specified Fe content and 60 g/m$^2$ of coating weight. The coated steel sheets were temper rolled, and were treated by A or B treatment, separately, described below, to form an oxide layer thereon having different thickness from each other, thus obtaining the samples No. 1 through 20. During forming the oxide layer, the rolling load in the temper rolling was varied to vary the area percentage of plateau of the coating layer which was flattened by the temper rolling.

i) Treatment A

The galvannealed steel sheets were immersed in respective aqueous solution of hydrogen peroxide acidified by sulfuric acid to pH 3, at 50° C., with varied content of hydrogen peroxide to each other.

ii) Treatment B

The galvannealed steel sheets were immersed in aqueous solutions acidified by sulfuric acid to pH 2, at 50° C., and were subjected to anodic electrolysis with varied current density and varied time for applying current.

Measurement was given on thus treated steel sheets in terms of Fe content in the coating layer, area percentage of plateau on the surface of flattened coating layer, thickness of oxide layer, and frictional coefficient $\mu$ as an index of press-formability. The measurement of thickness of oxide layer and the measurement of frictional coefficient were conducted as follows.

1) Measurement of Thickness of Oxide Layer

As described above, Auger electron spectroscopy combined with Ar ion sputtering was applied to give Ar sputtering for 30 seconds as a preliminary treatment to remove the contaminated layer on the surface. After that, the depth where the sum of the maximum value of O content and the value of succeedingly reduced in the O content to a stable level becomes ½ was determined at arbitrarily selected three points, and the average of the three point data was adopted as a thickness of oxide layer.

2) Measurement of Frictional Coefficient

Figure 2:
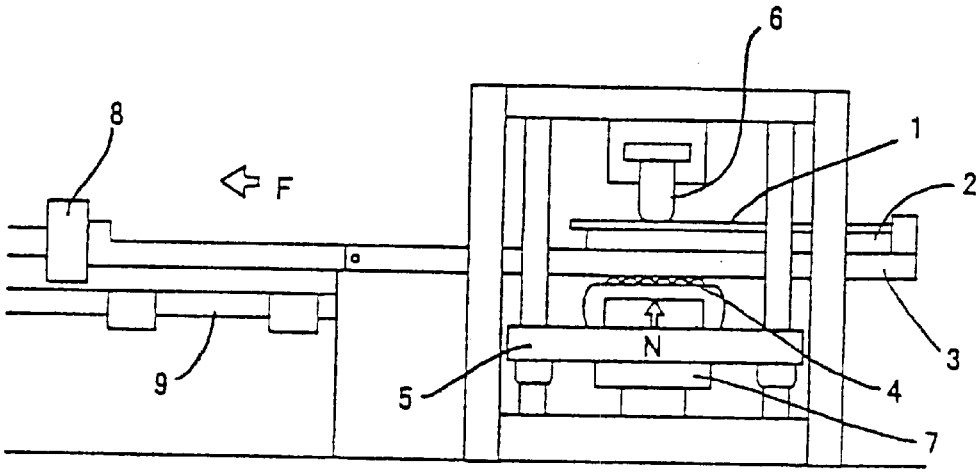
FIG. 2 shows an example of frictional coefficient determination apparatus.

FIG. 2 shows the frictional coefficient determination apparatus.

A sample 1 is fixed on a slide table 3 which moves horizontally on rollers 4 placed on a slide table holder 5 which is movable in vertical direction. The slide table holder 5 is lifted and is moved in horizontal direction while loading the sample 1 against a bead 6 placed above the sample 1. The load N to press the sample 1 against the bead 6 is determined by a load cell 7 attached to the slide table holder 5. The sliding resistance F to move the sample 1 in horizontal direction is determined by a load cell 8 attached to the slide table 3. Thus, the frictional coefficient $\mu$=F/N is derived. The test was conducted by applying a lubricant oil NOX-RUST 550HN, produced by Nihon Parkerizing Co., Ltd., onto the surface of the sample 1.

Figure 3:
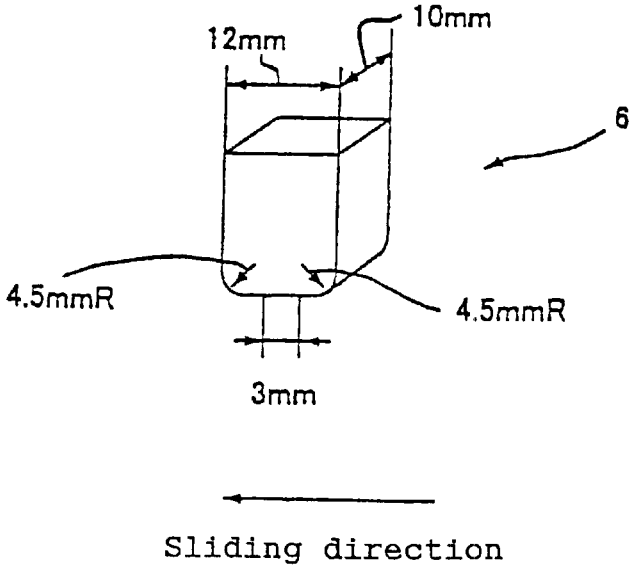
FIG. 3 shows an example of shape of bead f or determining the frictional coefficient.
Figure 4:
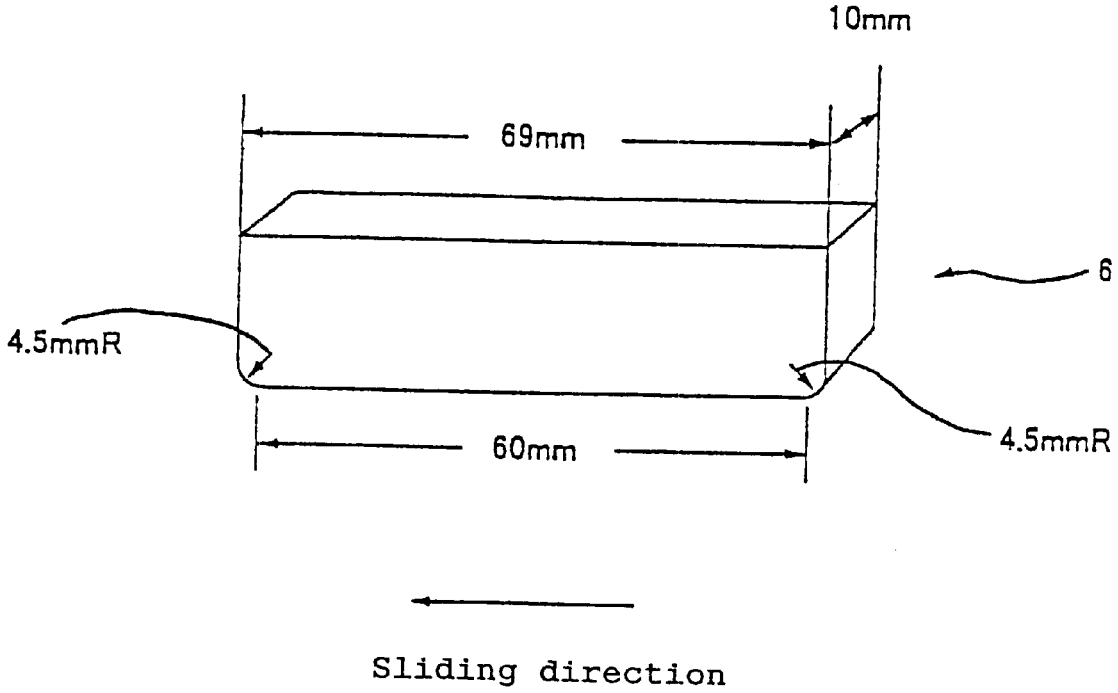
FIG. 4 shows another example of shape of bead for determining the frictional coefficient.

FIGS. 3 and 4 show the shape and dimensions of respective applied beads.

The bead shown in FIG. 3 has 10 mm in width, 12 mm in length in the sliding direction, and 4.5 mm in radius of curvature at lower section of both edges in the sliding direction. The bottom face of the bead where the bead is pressed against the sample has a flat plane with 10 mm in width and 3 mm in length in the sliding direction. The bead shown in FIG. 4 has 10 mm in width, 69 mm in length in the sliding direction, and 4.5 mm in radius of curvature at both edges of lower section in the sliding direction. The bottom face of the bead where the bead is pressed against the sample has a flat plane with 10 mm in width and 60 mm in length in the sliding direction.

For both cases, the sample 1 slides in a state that the bottom face of bead is pressed against the sample.

The test was conducted under two conditions given below.

Condition 1: With the bead shown in FIG. 3, load N of 400 kgf, and sample moving speed in horizontal direction of 100 cm/min.

Condition 2: With the bead shown in FIG. 4, load N of 400 kgf, and sample moving speed in horizontal direction of 20 cm/min.

The measurement of thickness of oxide layer and the measurement of frictional coefficient in the following-given examples were those applied in Example 1.

The result is given in Table 1.

The samples No. 1 through 17, which are examples according to the present invention, gave small frictional coefficient $\mu$, 0.160 or less under the condition 1 and 0.190 or less under the condition 2, and showed superior sliding performance. In particular, the samples No. 4 through 7 and 10 through 15 had the area percentage of plateau on the surface of flattened coating layer of 20 to 80% so that the frictional coefficient $\mu$ under the condition 2 was significantly decreased to 0.170 or smaller, which shows superior sliding performance.

To the contrary, the sample No. 18 as a comparative example where oxide layer is formed without applying temper rolling, the sample No. 19 as a comparative example that was not subjected to the treatment for forming oxide layer after temper rolling, and the sample No. 20 as a comparative example that had less than 10 nm of thickness of oxide layer showed large frictional coefficient $\mu$, giving poor sliding performance.

TABLE 1

| Sample No. | Treatment for forming oxide layer | Fe content in coating layer (wt %) | Thickness of oxide layer (nm) | Area percentage of plateau of flattened coating layer (%) | Frictional coefficient $\mu$ Condition 1 | Frictional coefficient $\mu$ Condition 2 | Remark |
|---|---|---|---|---|---|---|---|
| 1 | A | 10.3 | 16 | 2 | 0.153 | 0.183 | Example |
| 2 | A | 10.5 | 35 | 6 | 0.135 | 0.181 | Example |
| 3 | A | 10.2 | 28 | 10 | 0.135 | 0.181 | Example |
| 4 | A | 9.4 | 29 | 22 | 0.134 | 0.168 | Example |
| 5 | A | 11.2 | 22 | 38 | 0.136 | 0.168 | Example |
| 6 | A | 11.6 | 40 | 59 | 0.133 | 0.160 | Example |
| 7 | A | 10.8 | 16 | 80 | 0.150 | 0.159 | Example |
| 8 | A | 8.9 | 18 | 85 | 0.153 | 0.181 | Example |
| 9 | A | 13.0 | 26 | 100 | 0.138 | 0.187 | Example |
| 10 | A | 11.9 | 13 | 60 | 0.158 | 0.169 | Example |
| 11 | A | 9.0 | 14 | 55 | 0.153 | 0.165 | Example |
| 12 | B | 8.2 | 22 | 50 | 0.138 | 0.161 | Example |
| 13 | B | 10.6 | 68 | 55 | 0.133 | 0.162 | Example |
| 14 | B | 10.4 | 120 | 45 | 0.132 | 0.161 | Example |
| 15 | B | 12.5 | 220 | 50 | 0.132 | 0.162 | Example |
| 16 | B | 12.4 | 11 | 85 | 0.154 | 0.184 | Example |
| 17 | B | 11.0 | 13 | 14 | 0.155 | 0.181 | Example |
| 18 | without treatment | 11.8 | — | without temper rolling | 0.184 | 0.245 | Comparative Example |
| 19 | without treatment | 11.5 | 7 | 45 | 0.178 | 0.226 | Comparative Example |
| 20 | A | 9.8 | 9 | 42 | 0.171 | 0.214 | Comparative Example |

EXAMPLE 2

Galvannealed steel sheets having 0.8 mm in thickness and having varied $\zeta$ phase ratio with varied alloying conditions, separately, were temper-rolled. The steel sheets were immersed in an aqueous solution of sodium hydroxide of pH 12 to remove the oxide layer formed during alloying treatment. Then an oxide layer was formed on the surface of steel sheets applying the above-described treatment A or B, respectively, to obtain the samples No. 1 through 31. During the treatment, similar with Example 1, the load of temper rolling was varied to vary the area percentage of plateau on the surface of coating layer flattened by temper rolling.

Measurement was given on the coating layer in terms of Fe content in the coating layer, $\zeta/\delta$ value, area percentage of $\zeta$ phase, area percentage of plateau on the surface of flattened coating layer, thickness of oxide layer, and frictional coefficient.

The result is given in Tables 2 and 3.

The samples No. 9 through 13 as examples according to the present invention gave large $\zeta/\delta$ value and large area percentage of $\zeta$ phase, and even when the $\zeta$ phase distinctively exists in the surface, the frictional coefficient $\mu$ under the condition 1 was low, which gives superior sliding performance. In particular, the samples No. 11 through 24, which are the samples according to the present invention, having 20 nm or larger thickness of oxide layer gave small frictional coefficient $\mu$ under the condition 2, thus giving further improved sliding performance. The samples No. 5 through 8, which had small area percentage of plateau on the surface of flattened coating layer, having the thickness of oxide layer within the range of the present invention, did not decrease the frictional coefficient $\mu$ under the condition 2, though giving small frictional coefficient $\mu$ under the condition 1, thus resulting in less effect for improving the sliding performance.

On the other hand, the samples No. 1 through 4, which are comparative example having the thickness of oxide layer outside the range of the present invention, showed large frictional coefficients $\mu$, and gave poor sliding performance.

hydroxide of pH 12 to remove the oxide layer formed during alloying treatment. Then oxide layers of various thicknesses were formed on the surface of steel sheets applying the above-described treatment A and the treatments C and D given below, respectively, to obtain the samples No. 1 through 38. During the treatment, the load of temper rolling was varied to vary the area percentage of convex portions on the surface of coating layer flattened by temper rolling.

iii) Treatment C

Steam at 100° C. was sprayed against respective galvannealed steel sheets for different treatment periods.

TABLE 2

| Sample No. | Treatment for forming oxide layer | Treatment for removing oxide layer after temper rolling | Coating weight ($g/m^2$) | Fe content in coating layer (wt %) | $\zeta/\delta$ | Area percentage of $\zeta$ phase (%) | Thickness of oxide layer (nm) | Area percentage of plateau of flattened coating layer (%) | Frictional coefficient $\mu$ Condition 1 | Frictional coefficient $\mu$ Condition 2 | Remark |
|---|---|---|---|---|---|---|---|---|---|---|---|
| 1 | Not applied | Not applied | 39.4 | 8.7 | 0.389 | 34.8 | — | 0 | 0.194 | 0.258 | C |
| 2 | Not applied | Not applied | 43.5 | 8.9 | 0.422 | 36.8 | 6.2 | 43 | 0.189 | 0.244 | C |
| 3 | A | Not applied | 42.2 | 8.8 | 0.353 | 26.5 | 7.5 | 38 | 0.192 | 0.230 | C |
| 4 | B | Not applied | 48.8 | 9.4 | 0.390 | 24.8 | 7.9 | 49 | 0.190 | 0.239 | C |
| 5 | A | Applied | 41.5 | 8.5 | 0.304 | 38.8 | 12.6 | 10 | 0.165 | 0.233 | E |
| 6 | B | Applied | 39.6 | 9.2 | 0.362 | 39.3 | 19.5 | 15 | 0.168 | 0.244 | E |
| 7 | A | Applied | 42.6 | 7.6 | 0.637 | 28.8 | 13.1 | 86 | 0.167 | 0.236 | E |
| 8 | B | Applied | 57.4 | 9.0 | 0.637 | 36.8 | 15.5 | 90 | 0.169 | 0.241 | E |
| 9 | A | Applied | 46.1 | 7.9 | 0.429 | 40.8 | 16.5 | 46 | 0.139 | 0.231 | E |
| 10 | A | Applied | 47.6 | 8.4 | 0.501 | 30.8 | 15.3 | 52 | 0.141 | 0.234 | E |
| 11 | A | Applied | 39.1 | 8.5 | 0.225 | 22.0 | 14.7 | 38 | 0.142 | 0.229 | E |
| 12 | B | Applied | 40.4 | 8.6 | 0.418 | 24.5 | 13.4 | 55 | 0.141 | 0.241 | E |
| 13 | B | Applied | 43.1 | 8.4 | 0.381 | 18.5 | 17.1 | 50 | 0.139 | 0.237 | E |
| 14 | B | Applied | 41.0 | 9.6 | 0.260 | 41.5 | 15.4 | 50 | 0.140 | 0.235 | E |
| 15 | A | Applied | 43.5 | 9.7 | 0.264 | 27.3 | 30.5 | 46 | 0.135 | 0.173 | E |

E: Example
C: Comparative Example

TABLE 3

| Sample No. | Treatment for forming oxide layer | Treatment for removing oxide layer after temper rolling | Coating weight ($g/m^2$) | Fe content in coating layer (wt %) | $\zeta/\delta$ | Area percentage of $\zeta$ phase (%) | Thickness of oxide layer (nm) | Area percentage of plateau of flattened coating layer (%) | Frictional coefficient $\mu$ Condition 1 | Frictional coefficient $\mu$ Condition 2 | Remark |
|---|---|---|---|---|---|---|---|---|---|---|---|
| 16 | A | Applied | 50.3 | 9.5 | 0.224 | 27.3 | 34.3 | 58 | 0.134 | 0.172 | E |
| 17 | A | Applied | 40.6 | 9.0 | 0.262 | 26.3 | 31.5 | 54 | 0.128 | 0.164 | E |
| 18 | A | Applied | 40.2 | 9.5 | 0.339 | 33.0 | 33.0 | 54 | 0.124 | 0.176 | E |
| 19 | A | Applied | 42.4 | 8.4 | 0.530 | 24.3 | 51.8 | 50 | 0.125 | 0.178 | E |
| 20 | A | Applied | 46.5 | 8.2 | 0.442 | 30.8 | 82.6 | 45 | 0.125 | 0.171 | E |
| 21 | A | Applied | 44.0 | 8.7 | 0.428 | 27.0 | 167.5 | 53 | 0.126 | 0.165 | E |
| 22 | B | Applied | 47.9 | 9.4 | 0.314 | 26.8 | 46.1 | 45 | 0.124 | 0.166 | E |
| 23 | B | Applied | 44.2 | 8.8 | 0.316 | 30.3 | 52.8 | 50 | 0.125 | 0.166 | E |
| 24 | B | Applied | 40.3 | 8.4 | 0.401 | 19.4 | 44.4 | 49 | 0.131 | 0.162 | E |
| 25 | B | Applied | 39.9 | 8.5 | 0.285 | 17.9 | 47.8 | 67 | 0.127 | 0.166 | E |
| 26 | B | Applied | 41.9 | 9.2 | 0.315 | 16.5 | 82.8 | 57 | 0.133 | 0.169 | E |
| 27 | B | Applied | 43.7 | 8.4 | 0.288 | 24.5 | 112.5 | 60 | 0.132 | 0.169 | E |
| 28 | B | Applied | 48.8 | 8.6 | 0.315 | 32.5 | 126.5 | 54 | 0.129 | 0.162 | E |
| 29 | B | Applied | 49.3 | 8.6 | 0.01 | 1.8 | 14.0 | 55 | 0.140 | 0.211 | E |
| 30 | A | Applied | 48.5 | 8.6 | 0.15 | 2.8 | 31.5 | 55 | 0.130 | 0.196 | E |
| 31 | B | Applied | 48.3 | 9.3 | 0.07 | 4.5 | 68.9 | 51 | 0.128 | 0.166 | E |

E: Example
C: Comparative Example

EXAMPLE 3

Galvannealed steel sheets having 0.8 mm in thickness, prepared by a general method, were temper-rolled. The steel sheets were immersed in an aqueous solution of sodium iv) Treatment D The galvannealed steel sheets were heated to 250° C. in an atmosphere of oxygen content 40% for different treatment periods.

The measurement was given on the coating layer in terms of Fe content in the coating layer, area percentage of plateau on the surface of flattened coating layer, thickness of oxide layer, and frictional coefficient $\mu$.

The result is given in Tables 4 and 5.

The samples No. 6 through 38, which are the examples according to the present invention, showed small frictional coefficient $\mu$ under the condition 1, giving superior sliding performance. In particular, the samples No. 15 through 38, giving 20 nm or larger thickness of oxide layer, gave small frictional coefficient $\mu$ under the condition 2, and showed further improved sliding performance.

On the other hand, the samples No. 1 and 2, where was not removed the oxide layer formed during the alloying treatment and did not receive the treatment to form oxide layer, gave large frictional coefficient $\mu$ and showed poor sliding performance. The samples No. 3 through 5, which had thickness of oxide layer outside the range of the present invention, could not decrease the frictional coefficient $\mu$ to a satisfactory level, and were poor in sliding performance.

TABLE 4

| Sample No. | Treatment for forming oxide layer | Treatment for removing oxide layer after temper rolling | Fe content in coating layer (wt %) | Thickness of oxide layer (nm) | Area percentage of plateau of flattened coating layer (%) | Frictional coefficient $\mu$ Condition 1 | Frictional coefficient $\mu$ Condition 2 | Remark |
|---|---|---|---|---|---|---|---|---|
| 1 | without treatment | not applied | 9.9 | — | 0 | 0.185 | 0.258 | C |
| 2 | without treatment | not applied | 9.5 | 6.2 | 43 | 0.180 | 0.244 | C |
| 3 | C | not applied | 11.2 | 8.1 | 38 | 0.178 | 0.230 | C |
| 4 | D | not applied | 10.4 | 7.9 | 49 | 0.173 | 0.239 | C |
| 5 | A | not applied | 9.8 | 7.4 | 40 | 0.175 | 0.233 | C |
| 6 | C | applied | 9.9 | 12.6 | 10 | 0.164 | 0.244 | E |
| 7 | D | applied | 10.5 | 19.5 | 15 | 0.167 | 0.236 | E |
| 8 | A | applied | 10.6 | 22.4 | 14 | 0.163 | 0.241 | E |
| 9 | C | applied | 10.1 | 13.1 | 86 | 0.163 | 0.231 | E |
| 10 | D | applied | 8.9 | 15.5 | 90 | 0.166 | 0.234 | E |
| 11 | A | applied | 9.9 | 18.3 | 82 | 0.160 | 0.229 | E |
| 12 | C | applied | 11.5 | 16.5 | 51 | 0.132 | 0.241 | E |
| 13 | D | applied | 11.6 | 15.3 | 50 | 0.133 | 0.237 | E |
| 14 | A | applied | 10.0 | 14.7 | 50 | 0.130 | 0.235 | E |
| 15 | C | applied | 9.8 | 25.1 | 46 | 0.124 | 0.200 | E |
| 16 | D | applied | 11.1 | 14.8 | 58 | 0.132 | 0.195 | E |
| 17 | A | applied | 10.6 | 22.4 | 54 | 0.129 | 0.193 | E |

E: Example
C: Comparative example

TABLE 5

| Sample No. | Treatment for forming oxide layer | Treatment for removing oxide layer after temper rolling | Fe content in coating layer (wt %) | Thickness of oxide layer (nm) | Area percentage of plateau of flattened coating layer (%) | Frictional coefficient $\mu$ Condition 1 | Frictional coefficient $\mu$ Condition 2 | Remark |
|---|---|---|---|---|---|---|---|---|
| 18 | C | applied | 10.9 | 31.0 | 54 | 0.134 | 0.176 | E |
| 19 | C | applied | 10.9 | 32.5 | 50 | 0.125 | 0.178 | E |
| 20 | C | applied | 8.8 | 46.2 | 45 | 0.136 | 0.171 | E |
| 21 | C | applied | 8.6 | 51.3 | 53 | 0.127 | 0.165 | E |
| 22 | C | applied | 9.5 | 62.2 | 45 | 0.124 | 0.166 | E |
| 23 | C | applied | 9.8 | 82.4 | 50 | 0.125 | 0.166 | E |
| 24 | C | applied | 10.4 | 125 | 49 | 0.136 | 0.162 | E |
| 25 | D | applied | 9.4 | 33.4 | 67 | 0.127 | 0.176 | E |
| 26 | D | applied | 10.5 | 30.6 | 57 | 0.133 | 0.179 | E |
| 27 | D | applied | 10.4 | 45.9 | 60 | 0.132 | 0.169 | E |
| 28 | D | applied | 10.6 | 53.3 | 54 | 0.129 | 0.162 | E |
| 29 | D | applied | 10.6 | 68.1 | 58 | 0.128 | 0.166 | E |
| 30 | D | applied | 9.3 | 81.0 | 58 | 0.131 | 0.168 | E |
| 31 | D | applied | 9.5 | 146 | 63 | 0.129 | 0.165 | E |
| 32 | A | applied | 10.4 | 38.1 | 65 | 0.128 | 0.177 | E |
| 33 | A | applied | 9.6 | 34.5 | 64 | 0.126 | 0.175 | E |
| 34 | A | applied | 10.2 | 42.5 | 38 | 0.131 | 0.169 | E |
| 35 | A | applied | 9.8 | 56.1 | 66 | 0.131 | 0.164 | E |
| 36 | A | applied | 10.2 | 60.3 | 59 | 0.129 | 0.170 | E |

TABLE 5-continued

| Sample No. | Treatment for forming oxide layer | Treatment for removing oxide layer after temper rolling | Fe content in coating layer (wt %) | Thickness of oxide layer (nm) | Area percentage of plateau of flattened coating layer (%) | Frictional coefficient $\mu$ Condition 1 | Frictional coefficient $\mu$ Condition 2 | Remark |
|---|---|---|---|---|---|---|---|---|
| 37 | A | applied | 9.6 | 82.7 | 55 | 0.136 | 0.171 | E |
| 38 | A | applied | 10.4 | 131 | 56 | 0.127 | 0.166 | E |

E: Example
C: Comparative example

EXAMPLE 4

Galvannealed steel sheets having 0.8 mm in thickness, prepared by a general method, were temper-rolled. The steel sheets were immersed in an aqueous solution of sodium hydroxide of pH 12 to remove the oxide layer formed during alloying treatment. Then oxide layers of various thicknesses were formed on the surface of steel sheets applying repeated treatment cycles of 5 seconds of spray of filtered water at a specified temperature against the surface of the steel sheet, followed by immediate drying, thus obtained the samples No. 1 through 40. During the treatment, the load of temper rolling was varied to vary the area percentage of plateau on the surface of coating layer flattened by temper rolling.

The measurement was given on the coating layer in terms of Fe content in the coating layer, area percentage of plateau on the surface of flattened coating layer, thickness of oxide layer, and frictional coefficient $\mu$.

The result is given in Tables. 6 and 7.

The samples No. 11 through 40, which are the examples according to the present invention, gave small frictional coefficient $\mu$ under the condition 1 and showed superior sliding performance. In particular, the samples having 20 nm or larger thickness of oxide layer gave small frictional coefficient $\mu$ under the condition 2, and showed further improved sliding performance.

On the other hand, the samples No. 1 and 2, where was not removed the oxide layer formed during the alloying treatment and which did not receive repeated water spray and drying, gave large frictional coefficient $\mu$, and showed poor sliding performance. Even when these treatments were applied, the samples No. 3 through 10, which were treated under the conditions outside the range of the present invention, failed to sufficiently decrease the frictional coefficient $\mu$, and was poor in sliding performance.

TABLE 6

| Sample No. | Treatment of water contact and drying: Water temperature (° C.) | Treatment of water contact and drying: Number of repeating cycles | Treatment for removing oxide layer after temper rolling | Fe content in coating layer (wt %) | Thickness of oxide layer (nm) | Area percentage of plateau of flattened coating layer (%) | Frictional coefficient $\mu$ Condition 1 | Frictional coefficient $\mu$ Condition 2 | Remark |
|---|---|---|---|---|---|---|---|---|---|
| 1 | Not applied | | Not applied | 9.9 | — | 0 | 0.185 | 0.258 | Comparative example |
| 2 | Not applied | | Not applied | 9.5 | 6.2 | 43 | 0.180 | 0.244 | Comparative example |
| 3 | 50 | 3 | Not applied | 11.2 | 7.6 | 38 | 0.176 | 0.234 | Comparative example |
| 4 | 50 | 5 | Not applied | 10.4 | 7.5 | 49 | 0.171 | 0.241 | Comparative example |
| 5 | 50 | 10 | Not applied | 9.8 | 7.6 | 40 | 0.173 | 0.231 | Comparative example |
| 6 | 30 | 3 | Applied | 11.1 | 6.1 | 58 | 0.169 | 0.238 | Comparative example |
| 7 | 30 | 5 | Applied | 11.5 | 6.9 | 51 | 0.175 | 0.232 | Comparative example |
| 8 | 30 | 10 | Applied | 11.6 | 7.4 | 50 | 0.174 | 0.234 | Comparative example |
| 9 | 50 | 1 | Applied | 10.0 | 8.9 | 50 | 0.166 | 0.229 | Comparative example |
| 10 | 50 | 2 | Applied | 9.8 | 9.6 | 46 | 0.164 | 0.236 | Comparative example |
| 11 | 50 | 3 | Applied | 9.9 | 13.1 | 10 | 0.167 | 0.241 | Example |
| 12 | 50 | 5 | Applied | 10.5 | 22.5 | 15 | 0.164 | 0.233 | Example |
| 13 | 50 | 10 | Applied | 10.6 | 32.2 | 14 | 0.165 | 0.238 | Example |
| 14 | 50 | 3 | Applied | 10.1 | 12.6 | 86 | 0.167 | 0.233 | Example |
| 15 | 50 | 5 | Applied | 8.9 | 18.5 | 90 | 0.164 | 0.227 | Example |
| 16 | 50 | 10 | Applied | 9.9 | 36.8 | 82 | 0.165 | 0.228 | Example |
| 17 | 50 | 3 | Applied | 10.6 | 11.4 | 54 | 0.132 | 0.224 | Example |
| 18 | 50 | 5 | Applied | 10.9 | 21.3 | 54 | 0.133 | 0.209 | Example |

TABLE 6-continued

| Sample No. | Treatment of water contact and drying: Water temperature (° C.) | Treatment of water contact and drying: Number of repeating cycles | Treatment for removing oxide layer after temper rolling | Fe content in coating layer (wt %) | Thickness of oxide layer (nm) | Area percentage of plateau of flattened coating layer (%) | Frictional coefficient $\mu$: Condition 1 | Frictional coefficient $\mu$: Condition 2 | Remark |
|---|---|---|---|---|---|---|---|---|---|
| 19 | 50 | 10 | Applied | 10.9 | 34.5 | 50 | 0.130 | 0.174 | Example |
| 20 | 50 | 20 | Applied | 8.8 | 41.6 | 45 | 0.124 | 0.166 | Example |

TABLE 7

| Sample No. | Treatment of water contact and drying: Water temperature (° C.) | Treatment of water contact and drying: Number of repeating cycles | Treatment for removing oxide layer after temper rolling | Fe content in coating layer (wt %) | Thickness of oxide layer (nm) | Area percentage of plateau of flattened coating layer (%) | Frictional coefficient $\mu$: Condition 1 | Frictional coefficient $\mu$: Condition 2 | Remark |
|---|---|---|---|---|---|---|---|---|---|
| 21 | 60 | 3 | Applied | 9.6 | 13.4 | 34 | 0.138 | 0.221 | Example |
| 22 | 60 | 5 | Applied | 9.4 | 22.1 | 63 | 0.137 | 0.205 | Example |
| 23 | 60 | 10 | Applied | 10.6 | 30.4 | 46 | 0.136 | 0.175 | Example |
| 24 | 60 | 20 | Applied | 9.7 | 42.2 | 60 | 0.132 | 0.164 | Example |
| 25 | 70 | 3 | Applied | 8.6 | 16.7 | 53 | 0.132 | 0.221 | Example |
| 26 | 70 | 5 | Applied | 9.5 | 25.9 | 45 | 0.129 | 0.205 | Example |
| 27 | 70 | 10 | Applied | 9.8 | 37.9 | 50 | 0.134 | 0.171 | Example |
| 28 | 70 | 20 | Applied | 10.4 | 49.1 | 49 | 0.125 | 0.163 | Example |
| 29 | 80 | 3 | Applied | 9.4 | 19.1 | 60 | 0.136 | 0.209 | Example |
| 30 | 80 | 5 | Applied | 9.4 | 28.1 | 51 | 0.129 | 0.198 | Example |
| 31 | 80 | 10 | Applied | 9.1 | 39.5 | 52 | 0.131 | 0.168 | Example |
| 32 | 80 | 20 | Applied | 9.8 | 45.1 | 48 | 0.129 | 0.165 | Example |
| 33 | 90 | 3 | Applied | 8.9 | 20.3 | 69 | 0.130 | 0.199 | Example |
| 34 | 90 | 5 | Applied | 9.4 | 30.9 | 49 | 0.127 | 0.177 | Example |
| 35 | 90 | 10 | Applied | 9.2 | 39.7 | 62 | 0.127 | 0.170 | Example |
| 36 | 90 | 20 | Applied | 9.5 | 50.4 | 54 | 0.125 | 0.163 | Example |
| 37 | 100 | 3 | Applied | 9.4 | 26.5 | 67 | 0.136 | 0.200 | Example |
| 38 | 100 | 5 | Applied | 10.5 | 34.1 | 57 | 0.127 | 0.177 | Example |
| 39 | 100 | 10 | Applied | 10.4 | 43.7 | 60 | 0.124 | 0.165 | Example |
| 40 | 100 | 20 | Applied | 10.6 | 55.4 | 54 | 0.125 | 0.161 | Example |

EXAMPLE 5

Galvannealed steel sheets having 0.8 mm in thickness, prepared by a general method, were temper-rolled. The steel sheets were immersed in an aqueous solution of sodium hydroxide of pH 12 to remove the oxide layer formed during alloying treatment. Then oxide layers of various thicknesses were formed on the surface of steel sheets immersing in an aqueous solution acidified by sulfuric acid or in an Fe—Zn coating bath containing 1.0 mol/l of iron(II) sulfate and 0.1 mol/l of zinc sulfate, at a specified temperature and pH to obtain the samples No. 1 through 51. During the treatment, the load of temper rolling was varied to vary the area percentage of plateau on the surface of coating layer flattened by temper rolling. The pH adjustment of the Fe—Zn coating bath was done using dilute sulfuric acid.

The measurement was given on the coating layer in terms of Fe content in the coating layer, area percentage of plateau on the surface of flattened coating layer, thickness of oxide layer, and frictional coefficient $\mu$.

The result is given in Tables 8 and 9.

The samples No. 10 through 51, which are the examples according to the present invention, gave small frictional coefficient $\mu$ under the condition 1, and showed superior sliding performance. Particularly for the samples having 20 nm or larger thickness of oxide layer and having 20 to 80% of area percentage of plateau on the surface of coating layer gave small frictional coefficient $\mu$ under the condition 2, and showed further improved sliding performance.

On the other hand, the samples No. 1 and 2, where was not removed the oxide layer formed during the alloying treatment and which were not immersed in the acidic solution, gave large frictional coefficient $\mu$ and showed poor sliding performance. Even when these treatments were applied, the samples No. 3 through 9, which were treated under the conditions outside the range of the present invention, failed to sufficiently decrease the frictional coefficient $\mu$, and was poor in sliding performance.

TABLE 8

| Sample No. | Treatment of acidic soltuion: Kind of solution | pH | Temp. (° C.) | Temperature of water washing (° C.) | Treatment for removing oxide layer after temper rolling | Fe content in coating layer (wt %) | Thickness of oxide layer (nm) | Area percentage of plateau of flattened coating layer (%) | Frictional coefficient μ: Condition 1 | Condition 2 | Remark |
|---|---|---|---|---|---|---|---|---|---|---|---|
| 1 | — | — | — | — | Not applied | 9.6 | — | 0 | 0.185 | 0.258 | C |
| 2 | — | — | — | — | Not applied | 9.5 | 6.2 | 43 | 0.180 | 0.244 | C |
| 3 | Sulfuric acid | 2.0 | 50 | 50 | Not applied | 11.2 | 7.8 | 38 | 0.176 | 0.234 | C |
| 4 | Sulfuric acid | 2.0 | 70 | 50 | Not applied | 10.4 | 8.2 | 49 | 0.171 | 0.241 | C |
| 5 | Sulfuric acid | 2.0 | 70 | 70 | Not applied | 9.8 | 7.9 | 40 | 0.173 | 0.231 | C |
| 6 | Sulfuric acid | 2.0 | 50 | — | Applied | 11.5 | 6.9 | 51 | 0.175 | 0.232 | C |
| 7 | Sulfuric acid | 0.1 | 50 | 50 | Applied | 11.6 | 6.1 | 50 | 0.174 | 0.234 | C |
| 8 | Sulfuric acid | 2.0 | 30 | 50 | Applied | 10.0 | 7.5 | 50 | 0.166 | 0.229 | C |
| 9 | Sulfuric acid | 2.0 | 50 | 30 | Applied | 9.8 | 8.1 | 46 | 0.164 | 0.236 | C |
| 10 | Sulfuric acid | 2.0 | 50 | 50 | Applied | 9.9 | 12.2 | 10 | 0.167 | 0.241 | E |
| 11 | Sulfuric acid | 2.0 | 70 | 50 | Applied | 10.5 | 19.4 | 15 | 0.164 | 0.233 | E |
| 12 | Sulfuric acid | 2.0 | 70 | 70 | Applied | 10.6 | 22.6 | 14 | 0.165 | 0.238 | E |
| 13 | Sulfuric acid | 2.0 | 50 | 50 | Applied | 10.1 | 14.2 | 86 | 0.167 | 0.233 | E |
| 14 | Sulfuric acid | 2.0 | 70 | 50 | Applied | 8.9 | 17.4 | 90 | 0.164 | 0.227 | E |
| 15 | Sulfuric acid | 2.0 | 70 | 70 | Applied | 9.9 | 23.6 | 82 | 0.165 | 0.228 | E |
| 16 | Sulfuric acid | 2.0 | 50 | 50 | Applied | 10.6 | 11.1 | 54 | 0.132 | 0.227 | E |
| 17 | Sulfuric acid | 2.0 | 50 | 70 | Applied | 10.9 | 18.9 | 54 | 0.133 | 0.214 | E |
| 18 | Sulfuric acid | 2.0 | 50 | 100 | Applied | 10.9 | 23.4 | 50 | 0.130 | 0.209 | E |
| 19 | Sulfuric acid | 2.0 | 70 | 50 | Applied | 8.8 | 16.4 | 45 | 0.124 | 0.231 | E |
| 20 | Sulfuric acid | 2.0 | 70 | 70 | Applied | 9.6 | 25.7 | 34 | 0.138 | 0.219 | E |
| 21 | Sulfuric acid | 2.0 | 70 | 100 | Applied | 9.4 | 31.1 | 63 | 0.137 | 0.175 | E |
| 22 | Sulfuric acid | 2.0 | 80 | 50 | Applied | 10.6 | 28.4 | 46 | 0.136 | 0.201 | E |
| 23 | Sulfuric acid | 2.0 | 80 | 70 | Applied | 9.7 | 34.8 | 60 | 0.132 | 0.169 | E |
| 24 | Sulfuric acid | 2.0 | 80 | 100 | Applied | 8.6 | 40.7 | 53 | 0.132 | 0.164 | E |

E: Example
C: Comparative example

TABLE 9

| Sample No. | Treatment of acidic soltuion: Kind of solution | pH | Temp. (° C.) | Temperature of water washing (° C.) | Treatment for removing oxide layer after temper rolling | Fe content in coating layer (wt %) | Thickness of oxide layer (nm) | Area percentage of plateau of flattened coating layer (%) | Frictional coefficient μ: Condition 1 | Condition 2 | Remark |
|---|---|---|---|---|---|---|---|---|---|---|---|
| 25 | Sulfuric acid | 1.0 | 50 | 50 | Applied | 9.5 | 10.6 | 45 | 0.129 | 0.238 | E |
| 26 | Sulfuric acid | 1.0 | 50 | 70 | Applied | 9.8 | 18.4 | 50 | 0.134 | 0.220 | E |
| 27 | Sulfuric acid | 1.0 | 50 | 100 | Applied | 10.4 | 22.9 | 49 | 0.125 | 0.213 | E |
| 28 | Sulfuric acid | 1.0 | 70 | 50 | Applied | 9.4 | 15.9 | 60 | 0.136 | 0.225 | E |
| 29 | Sulfuric acid | 1.0 | 70 | 70 | Applied | 9.4 | 25.2 | 51 | 0.129 | 0.211 | E |
| 30 | Sulfuric acid | 1.0 | 70 | 100 | Applied | 9.1 | 30.6 | 52 | 0.131 | 0.178 | E |
| 31 | Sulfuric acid | 1.0 | 80 | 50 | Applied | 9.8 | 27.9 | 48 | 0.129 | 0.221 | E |
| 32 | Sulfuric acid | 1.0 | 80 | 70 | Applied | 8.9 | 34.3 | 69 | 0.130 | 0.171 | E |
| 33 | Sulfuric acid | 1.0 | 80 | 100 | Applied | 9.4 | 40.2 | 49 | 0.127 | 0.164 | E |
| 34 | Sulfuric acid | 3.0 | 50 | 50 | Applied | 9.2 | 24.8 | 62 | 0.127 | 0.205 | E |
| 35 | Sulfuric acid | 3.0 | 50 | 70 | Applied | 9.5 | 32.4 | 54 | 0.125 | 0.172 | E |

TABLE 9-continued

| Sample No. | Treatment of acidic soltuion: Kind of solution | pH | Temp. (° C.) | Temperature of water washing (° C.) | Treatment for removing oxide layer after temper rolling | Fe content in coating layer (wt %) | Thickness of oxide layer (nm) | Area percentage of plateau of flattened coating layer (%) | Frictional coefficient μ: Condition 1 | Condition 2 | Remark |
|---|---|---|---|---|---|---|---|---|---|---|---|
| 36 | Sulfuric acid | 3.0 | 70 | 100 | Applied | 9.4 | 39.8 | 67 | 0.136 | 0.168 | E |
| 37 | Sulfuric acid | 3.0 | 70 | 50 | Applied | 10.5 | 30.1 | 57 | 0.127 | 0.176 | E |
| 38 | Sulfuric acid | 3.0 | 70 | 70 | Applied | 10.4 | 41.3 | 60 | 0.124 | 0.164 | E |
| 39 | Sulfuric acid | 3.0 | 80 | 100 | Applied | 10.6 | 50.9 | 54 | 0.125 | 0.161 | E |
| 40 | Sulfuric acid | 3.0 | 80 | 50 | Applied | 10.2 | 33.8 | 44 | 0.134 | 0.167 | E |
| 41 | Sulfuric acid | 3.0 | 80 | 70 | Applied | 9.6 | 45.7 | 49 | 0.129 | 0.164 | E |
| 42 | Sulfuric acid | 3.0 | 80 | 100 | Applied | 8.9 | 54.6 | 53 | 0.126 | 0.162 | E |
| 43 | Fe—Zn coating bath | 2.0 | 50 | 50 | Applied | 9.1 | 11.9 | 38 | 0.130 | 0.221 | E |
| 44 | Fe—Zn coating bath | 2.0 | 50 | 70 | Applied | 9.2 | 19.7 | 46 | 0.129 | 0.210 | E |
| 45 | Fe—Zn coating bath | 2.0 | 50 | 100 | Applied | 8.8 | 24.2 | 64 | 0.138 | 0.211 | E |
| 46 | Fe—Zn coating bath | 2.0 | 70 | 50 | Applied | 9.4 | 17.2 | 51 | 0.133 | 0.209 | E |
| 47 | Fe—Zn coating bath | 2.0 | 70 | 70 | Applied | 10.6 | 26.5 | 58 | 0.132 | 0.212 | E |
| 48 | Fe—Zn coating bath | 2.0 | 70 | 100 | Applied | 12.3 | 31.9 | 46 | 0.136 | 0.168 | E |
| 49 | Fe—Zn coating bath | 2.0 | 80 | 50 | Applied | 11.0 | 29.2 | 61 | 0.130 | 0.181 | E |
| 50 | Fe—Zn coating bath | 2.0 | 80 | 70 | Applied | 10.6 | 35.6 | 52 | 0.134 | 0.176 | E |
| 51 | Fe—Zn coating bath | 2.0 | 80 | 100 | Applied | 10.7 | 41.5 | 55 | 0.132 | 0.189 | E |

E: Example
C: Comparative example

EXAMPLE 6

Galvannealed steel sheets having 0.8 mm in thickness, prepared by a general method, were temper-rolled. The steel sheets were immersed in an aqueous solution of sodium hydroxide of pH 12 to remove the oxide layer formed during alloying treatment. Then oxide layers of various thicknesses were formed on the surface of steel sheets by immersing in an aqueous solution prepared by diluting an Fe—Zn coating bath containing 1.0 mol/l of iron(II) sulfate and 0.1 mol/l of zinc sulfate, at pH 2 to obtain the samples No. 1 through 39. During the treatment, the load of temper rolling was varied to vary the area percentage of plateau on the surface of coating layer flattened by temper rolling.

The measurement was given on the coating layer in terms of Fe content in the coating layer, area percentage of plateau on the surface of flattened coating layer, thickness of oxide layer, and frictional coefficient $\mu$.

The result is given in Tables 10 and 11.

The samples No. 12 through 39, which are the examples according to the present invention, gave small frictional coefficient $\mu$, and showed superior sliding performance. In particular, the samples having 20 nm or larger thickness of oxide layer gave small frictional coefficient $\mu$ under the condition 2, and showed further improved sliding performance.

On the other hand, the samples No. 1 and 2, where was not removed the oxide layer formed during the alloying treatment and which were not immersed in the solution prepared by diluting the Fe—Zn coating bath, gave large frictional coefficient $\mu$ and showed poor sliding performance. Even when these treatments were applied, the samples No. 3 through 11, which were treated under the conditions outside the range of the present invention, failed to sufficiently decrease the frictional coefficient $\mu$, and was poor in sliding performance.

TABLE 10

| Sample No. | Treatment in Fe—Zn coating bath: Dilution rate (fold) | Temp. (° C.) | Contact time (sec) | Treatment for removing oxide layer after temper rolling | Fe content in coating layer (wt %) | Thickness of oxide layer (nm) | Area percentage of plateau of flattened coating layer (%) | Frictional coefficient μ: Condition 1 | Condition 2 | Remark |
|---|---|---|---|---|---|---|---|---|---|---|
| 1 | — | — | — | Not applied | 9.9 | — | 0 | 0.185 | 0.258 | C |
| 2 | — | — | — | Not applied | 9.5 | 6.2 | 43 | 0.180 | 0.244 | C |
| 3 | 100 | 50 | 30 | Not applied | 11.2 | 7.6 | 38 | 0.176 | 0.234 | C |
| 4 | 100 | 70 | 30 | Not applied | 10.4 | 8.0 | 49 | 0.171 | 0.241 | C |
| 5 | 1000 | 70 | 30 | Not applied | 9.8 | 7.7 | 40 | 0.173 | 0.231 | C |
| 6 | 10 | 50 | 30 | Applied | 11.1 | 6.4 | 58 | 0.169 | 0.238 | C |

TABLE 10-continued

| Sample No. | Treatment in Fe—Zn coating bath: Dilution rate (fold) | Treatment in Fe—Zn coating bath: Temp. (° C.) | Treatment in Fe—Zn coating bath: Contact time (sec) | Treatment for removing oxide layer after temper rolling | Fe content in coating layer (wt %) | Thickness of oxide layer (nm) | Area percentage of plateau of flattened coating layer (%) | Frictional coefficient μ: Condition 1 | Frictional coefficient μ: Condition 2 | Remark |
|---|---|---|---|---|---|---|---|---|---|---|
| 7 | 20 | 50 | 30 | Applied | 11.5 | 6.8 | 51 | 0.175 | 0.232 | C |
| 8 | 50 | 50 | 30 | Applied | 11.6 | 7.4 | 50 | 0.174 | 0.234 | C |
| 9 | 100 | 20 | 30 | Applied | 10.0 | 6.9 | 50 | 0.175 | 0.229 | C |
| 10 | 100 | 30 | 30 | Applied | 9.8 | 7.1 | 46 | 0.177 | 0.236 | C |
| 11 | 100 | 40 | 30 | Applied | 9.6 | 7.3 | 49 | 0.171 | 0.241 | C |
| 12 | 100 | 50 | 30 | Applied | 9.9 | 13.4 | 10 | 0.165 | 0.239 | E |
| 13 | 100 | 50 | 30 | Applied | 10.6 | 14.4 | 14 | 0.164 | 0.235 | E |
| 14 | 100 | 50 | 30 | Applied | 10.1 | 16.8 | 86 | 0.161 | 0.231 | E |
| 15 | 100 | 50 | 30 | Applied | 8.9 | 15.1 | 90 | 0.165 | 0.240 | E |
| 16 | 100 | 50 | 10 | Applied | 10.6 | 11.1 | 54 | 0.132 | 0.227 | E |
| 17 | 100 | 50 | 20 | Applied | 10.9 | 15.7 | 54 | 0.133 | 0.214 | E |
| 18 | 100 | 50 | 30 | Applied | 10.9 | 16.3 | 50 | 0.130 | 0.209 | E |
| 19 | 100 | 50 | 60 | Applied | 8.8 | 20.1 | 45 | 0.124 | 0.201 | E |

E: Example
C: Comparative example

TABLE 11

| Sample No. | Treatment in Fe—Zn coating bath: Dilution rate (fold) | Treatment in Fe—Zn coating bath: Temp. (° C.) | Treatment in Fe—Zn coating bath: Contact time (sec) | Treatment for removing oxide layer after temper rolling | Fe content in coating layer (wt %) | Thickness of oxide layer (nm) | Area percentage of plateau of flattened coating layer (%) | Frictional coefficient μ: Condition 1 | Frictional coefficient μ: Condition 2 | Remark |
|---|---|---|---|---|---|---|---|---|---|---|
| 20 | 100 | 70 | 10 | Applied | 9.6 | 12.7 | 34 | 0.138 | 0.221 | E |
| 21 | 100 | 70 | 20 | Applied | 9.4 | 18.1 | 63 | 0.137 | 0.204 | E |
| 22 | 100 | 70 | 30 | Applied | 10.6 | 23.7 | 46 | 0.136 | 0.199 | E |
| 23 | 100 | 70 | 60 | Applied | 9.7 | 34.1 | 60 | 0.132 | 0.164 | E |
| 24 | 100 | 100 | 10 | Applied | 8.6 | 25.1 | 53 | 0.132 | 0.198 | E |
| 25 | 100 | 100 | 20 | Applied | 9.5 | 29.7 | 45 | 0.129 | 0.199 | E |
| 26 | 100 | 100 | 30 | Applied | 9.8 | 34.1 | 50 | 0.134 | 0.168 | E |
| 27 | 100 | 100 | 60 | Applied | 10.4 | 46.1 | 49 | 0.125 | 0.165 | E |
| 28 | 1000 | 50 | 10 | Applied | 9.4 | 18.9 | 60 | 0.136 | 0.204 | E |
| 29 | 1000 | 50 | 20 | Applied | 9.4 | 23.5 | 51 | 0.129 | 0.200 | E |
| 30 | 1000 | 50 | 30 | Applied | 9.1 | 27.1 | 52 | 0.131 | 0.199 | E |
| 31 | 1000 | 50 | 60 | Applied | 9.8 | 34.5 | 48 | 0.129 | 0.166 | E |
| 32 | 1000 | 70 | 10 | Applied | 8.9 | 21.9 | 69 | 0.130 | 0.204 | E |
| 33 | 1000 | 70 | 20 | Applied | 9.4 | 31.3 | 49 | 0.127 | 0.168 | E |
| 34 | 1000 | 70 | 30 | Applied | 92 | 40.1 | 62 | 0.127 | 0.164 | E |
| 35 | 1000 | 70 | 60 | Applied | 9.5 | 50.0 | 54 | 0.125 | 0.161 | E |
| 36 | 1000 | 100 | 10 | Applied | 9.4 | 25.7 | 67 | 0.136 | 0.201 | E |
| 37 | 1000 | 100 | 20 | Applied | 10.5 | 32.4 | 57 | 0.127 | 0.165 | E |
| 38 | 1000 | 100 | 30 | Applied | 10.4 | 41.7 | 60 | 0.124 | 0.165 | E |
| 39 | 1000 | 100 | 60 | Applied | 10.6 | 55.4 | 54 | 0.125 | 0.160 | E |

E: Example
C: Comparative example

EXAMPLE 7

Galvannealed steel sheets having 0.8 mm in thickness, prepared by a general method, were temper-rolled. Using the oxide layer forming and treating apparatus shown in FIG. 5, oxide layers having difference thickness were formed on the surface thereof, thus preparing the samples No. 1 through 20. During the treatment, the load of temper rolling was varied to adjust the area percentage of plateau on the surface of coating layer flattened by temper rolling to a range of from 20 to 80%.

Figure 5:
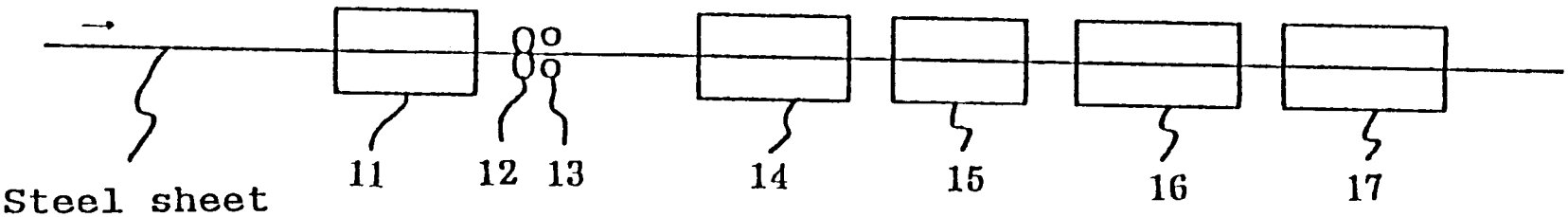
FIG. 5 shows an example of oxide layer forming and treating apparatus.

According to the oxide layer forming and treating apparatus given in FIG. 5, a galvannealed steel sheet was immersed in an acidic solution tank 11 which was filled with a solution acidified by sulfuric acid, regulated to 50° C. and pH 5, and the coating weight of the acidic solution on the surface of the steel sheet was adjusted using squeezing rolls 12, followed by washing the surface thereof in a #1 washing tank 14 using 50° C. hot water spray. The washed steel sheet passes through a neutralization tank 15. Then, the steel sheet was washed in a #2 washing tank 16 using 50° C. hot water spraying, and was dried in a drier 17, thus forming the oxide layer on the surface of the steel sheet.

For some samples, the coating weight of the acidic solution was adjusted by the squeezing rolls 12, then a shower water washing unit 13 was applied, or the neutralization tank 15 was applied to neutralize the acidic solution remained on the surface of the steel sheet using spraying an aqueous solution of sodium hydroxide at 10 pH. At that moment, the coating weight of the acidic solution and the time for allowing standing the steel sheet before starting the washing in the #1 washing tank or in the shower water washing unit 13 were varied.

The measurement was given on the coating layer in terms of Fe content in the coating layer, area percentage of plateau on the surface of flattened coating layer, thickness of oxide layer, and frictional coefficient $\mu$. In addition, after applying an anti-rust oil to the surface of the steel sheet, the steel sheet was allowed standing outdoors while taking care not receiving external disturbance. After six months of standing outdoors, the surface was checked to identify the presence (X) and absence (○) of spot rusting.

The result is given in Table 12.

All the tested samples gave small frictional coefficient $\mu$ and showed superior sliding performance. For the case of, however, 1.0 to 30.0 sec of standing time between applying acidic solution and starting washing, or 3.0 g/mm$^2$ or less of coating weight of acidic solution gave smaller frictional coefficient $\mu$ and showed further improved sliding performance. Neutralization after washing can suppress the occurrence of spot rusting.

TABLE 12

| Sample No. | Coating weight of acid in solution (g/m$^2$) | Time for allowing standing after contacted with acid (sec) | Use of neutralization tank | Fe content in coating layer (wt %) | Thickness of oxide layer (nm) | Area percentage of plateau of flattened coating layer (%) | Frictional coefficient $\mu$ Condition 1 | Frictional coefficient $\mu$ Condition 2 | Presence/absence of rust spotting |
|---|---|---|---|---|---|---|---|---|---|
| 1 | 5.0 | 0 | — | 9.4 | 10.2 | 34 | 0.173 | 0.231 | x |
| 2 | 5.0 | 0.5 | — | 10.6 | 10.8 | 63 | 0.170 | 0.229 | x |
| 3 | 5.0 | 1.0 | — | 9.9 | 11.8 | 46 | 0.165 | 0.221 | x |
| 4 | 5.0 | 2.0 | — | 10.9 | 15.4 | 60 | 0.158 | 0.215 | x |
| 5 | 5.0 | 5.0 | — | 10.9 | 20.1 | 53 | 0.140 | 0.200 | x |
| 6 | 5.0 | 10.0 | — | 10.0 | 21.1 | 45 | 0.139 | 0.198 | x |
| 7 | 5.0 | 20.0 | — | 10.6 | 21.8 | 50 | 0.139 | 0.200 | x |
| 8 | 5.0 | 30.0 | — | 10.6 | 22.0 | 49 | 0.138 | 0.200 | x |
| 9 | 3.0 | 1.0 | — | 10.8 | 13.4 | 60 | 0.160 | 0.215 | x |
| 10 | 3.0 | 2.0 | — | 10.5 | 17.7 | 51 | 0.155 | 0.210 | x |
| 11 | 3.0 | 5.0 | — | 10.5 | 22.4 | 52 | 0.135 | 0.197 | x |
| 12 | 3.0 | 10.0 | — | 10.7 | 25.1 | 48 | 0.134 | 0.195 | x |
| 13 | 3.0 | 20.0 | — | 11.1 | 26.4 | 69 | 0.133 | 0.196 | x |
| 14 | 3.0 | 30.0 | — | 10.9 | 27.1 | 49 | 0.135 | 0.194 | x |
| 15 | 1.0 | 1.0 | ○ | 11.7 | 14.1 | 62 | 0.158 | 0.216 | ○ |
| 16 | 1.0 | 2.0 | ○ | 10.4 | 18.8 | 54 | 0.157 | 0.211 | ○ |
| 17 | 1.0 | 5.0 | ○ | 10.5 | 22.6 | 67 | 0.134 | 0.194 | ○ |
| 18 | 1.0 | 10.0 | ○ | 9.9 | 25.9 | 57 | 0.132 | 0.191 | ○ |
| 19 | 1.0 | 20.0 | ○ | 10.3 | 27.0 | 60 | 0.133 | 0.195 | ○ |
| 20 | 1.0 | 30.0 | ○ | 10.9 | 27.9 | 54 | 0.133 | 0.194 | ○ |

What is claimed is:

1. A galvannealed steel sheet comprising an oxide layer having 10 nm or larger thickness on plateau of the surface of coating layer flattened by temper rolling.

2. The galvannealed steel sheet of claim 1, wherein the area percentage of the plateau of the flattened coating layer is 20 to 80%.

3. The galvannealed steel sheet of claim 1, wherein the coating layer is a single layer of δ1 phase.

4. The galvannealed steel sheet of claim 2, wherein the coating layer is a single layer of δ1 phase.

5. The galvannealed steel sheet of claim 1, wherein the coating layer consists mainly of δ1 phase and contains ζ phase.

6. The galvannealed steel sheet of claim 2, wherein the coating layer consists mainly of δ1 phase and contains ζ phase.

7. The galvannealed steel sheet of claim 5, wherein ζ phase exists in the surface of the coating layer on at least one side of the steel sheet.

8. The galvannealed steel sheet of claim 6, wherein ζ phase exists in the surface of the coating layer on at least one side of the steel sheet.

9. The galvannealed steel sheet of claim 7, wherein the X-ray diffraction peak ratio (ζ/δ) between the ζ phase and the δ1 phase in the coating layer is 0.2 or more.

10. The galvannealed steel sheet of claim 8, wherein the X-ray diffraction peak ratio (ζ/δ) between the ζ phase and the δ1 phase in the coating layer is 0.2 or more.

11. The galvannealed steel sheet of claim 7, wherein the area percentage of ζ phase existing in the surface of the coating layer is 10% or more.

12. The galvannealed steel sheet of claim 8 wherein the area percentage of ζ phase existing in the surface of the coating layer is 10% or more.

13. A method for manufacturing a galvannealed steel sheet comprising the steps of: applying hot dip galvanization to a steel sheet; heating the hot dip galvanized steel sheet to alloy the coating layer; applying temper rolling to the galvannealed steel sheet; and forming a Zn-base oxide layer on the surface of coating layer of the galvannealed steel sheet after the temper rolling.

14. The method for manufacturing a galvannealed steel sheet of claim 13 further comprising the steps of: removing the oxide layer formed during alloying treatment after temper rolling to activate the surface; and forming an oxide layer on the surface.

15. The method for manufacturing a galvannealed steel sheet of claim 13, wherein the formation of oxide layer is conducted under the contact of the steel sheet with high temperature steam.

16. The method for manufacturing a galvannealed steel sheet of claim 13, wherein the formation of oxide layer is conducted by heating the steel sheet in an atmosphere of 20% or higher oxygen content.

17. The method for manufacturing a galvannealed steel sheet of claim 13, wherein the formation of oxide layer is conducted under the contact of the steel sheet with an aqueous solution containing an oxidizing agent.

18. The method for manufacturing a galvannealed steel sheet of claim 13, wherein the formation of oxide layer is conducted by repeating the treatment cycles of contact between the steel sheet and water followed by immediate drying of the steel sheet.

19. The method for manufacturing a galvannealed steel sheet of claim 18, wherein the contacting water is at 50° C. or higher temperature.

20. The method for manufacturing a galvannealed steel sheet of claim 18, wherein the number of repeated treatment cycles of contact between the steel sheet and water followed by immediate drying of the steel sheet is three or more.

21. The method for manufacturing a galvannealed steel sheet of claim 20, wherein the number of repeated treatment cycles of contact between the steel sheet and water followed by immediate drying of the steel sheet is three or more.

22. The method for manufacturing a galvannealed steel sheet of claim 13, wherein the formation of oxide layer is conducted under the contact of the steel sheet with an acidic solution, and by washing the steel sheet with water.

23. The method for manufacturing a galvannealed steel sheet of claim 22, wherein pH of the acidic solution is 1 or more, and the temperature thereof is 50° C. or above.

24. The method for manufacturing a galvannealed steel sheet of claim 22, wherein the coating weight of the contacted acidic solution is 3.0 $g/m^2$ or less per side of the steel sheet.

25. The method for manufacturing a galvannealed steel sheet of claim 22, wherein the washing water is hot water at 50° C. or above.

26. The method for manufacturing a galvannealed steel sheet of claim 22, wherein the washing with water is given after allowing the steel sheet standing for 1.0 to 3.0 sec after contacted with the acidic solution.

27. The method for manufacturing a galvannealed steel sheet of claim 25 further comprising the step of applying neutralization treatment after water washing.

28. The method for manufacturing a galvannealed steel sheet of claim 22, wherein the acidic solution contains Fe ion and/or Zn ion.

29. The method for manufacturing a galvannealed steel sheet of claim 28, wherein the acidic solution containing Fe ion and/or Zn ion further contains one or more of sulfate, nitrate, and chloride of Fe and/or Zn.

* * * * *

UNITED STATES PATENT AND TRADEMARK OFFICE

CERTIFICATE OF CORRECTION

PATENT NO. : 6,699,592 B2
DATED : March 2, 2004
INVENTOR(S) : Shiochiro Taira et al.

It is certified that error appears in the above-identified patent and that said Letters Patent is hereby corrected as shown below:

Column 26,
Line 13, replace "3.0 sec" with -- 30.0 sec --.

Signed and Sealed this

Twelfth Day of October, 2004

JON W. DUDAS
*Director of the United States Patent and Trademark Office*